US010424849B2

(12) United States Patent
Staab et al.

(10) Patent No.: US 10,424,849 B2
(45) Date of Patent: Sep. 24, 2019

(54) CRIMP CONNECTION SYSTEM FOR ELECTRICAL CABLES COMPRISING A FASTENING SLEEVE

(71) Applicant: Aptiv Technologies Limited, St. Michael (BB)

(72) Inventors: Christian Staab, Remscheid (DE); Dirk Nolzen, Wuppertal (DE)

(73) Assignee: APTIV TECHNOLOGIES LIMITED (BB)

( * ) Notice: Subject to any disclaimer, the term of this patent is extended or adjusted under 35 U.S.C. 154(b) by 10 days.

(21) Appl. No.: 15/575,419

(22) PCT Filed: May 18, 2016

(86) PCT No.: PCT/EP2016/061140

§ 371 (c)(1),
(2) Date: Nov. 20, 2017

(87) PCT Pub. No.: WO2016/184914

PCT Pub. Date: Nov. 24, 2016

(65) Prior Publication Data

US 2018/0166798 A1 Jun. 14, 2018

(30) Foreign Application Priority Data

May 21, 2015 (EP) ..... 15168742

(51) Int. Cl.
*H01R 4/00* (2006.01)
*H01R 4/20* (2006.01)
(Continued)

(52) U.S. Cl.
CPC ..... *H01R 4/20* (2013.01); *H01R 4/183* (2013.01); *H01R 4/203* (2013.01); *H01R 4/2495* (2013.01); *H01R 43/058* (2013.01)

(58) Field of Classification Search
CPC . H01R 4/20; H01R 4/21; H01R 4/183; H01R 4/203; H01R 4/2495; H01R 43/058
(Continued)

(56) References Cited

U.S. PATENT DOCUMENTS 3,594,713 A * 7/1971 Thoman ..... H01R 4/206 439/730
3,955,044 A * 5/1976 Hoffman ..... H01R 4/203 174/84 C
(Continued)

FOREIGN PATENT DOCUMENTS

CN 1305244 A 7/2001
CN 101465478 A 6/2009
(Continued)

*Primary Examiner* — William H. Mayo, III
(74) *Attorney, Agent, or Firm* — Robert J. Myers

(57) ABSTRACT

A crimp connection system for electrical cables, including an electrical cable having a stripped cable end and a fastening sleeve. The stripped cable end is arranged at least partially within the fastening sleeve. The fastening sleeve has a number of fastening protrusions extending from the interior and/or outer surfaces of the fastening sleeve. The fastening protrusions are distributed over the interior and/or outer surfaces of the fastening sleeve. The crimp connection system also includes a contact terminal having a crimp portion. The fastening sleeve is arranged at least partially within the crimp portion.

16 Claims, 4 Drawing Sheets

(51) Int. Cl.
*H01R 4/18* (2006.01)
*H01R 4/2495* (2018.01)
*H01R 43/058* (2006.01)

(58) Field of Classification Search
USPC ..... 174/74 R, 75 R, 84 R, 88 R, 90, 91, 92
See application file for complete search history.

(56) References Cited

U.S. PATENT DOCUMENTS

| | | | | |
|---|---|---|---|---|
| 5,514,836 | A * | 5/1996 | Delalle | H01R 4/22 174/74 R |
| 7,775,842 | B2 | 8/2010 | Yamagami | |
| 8,519,267 | B2 * | 8/2013 | Peters | H01R 4/203 174/122 C |
| 9,099,793 | B2 * | 8/2015 | Matsushita | H01R 4/184 |
| 9,147,944 | B2 | 9/2015 | Aizawa et al. | |
| 9,196,971 | B2 * | 11/2015 | Gery | H01R 4/203 |
| 9,385,449 | B2 * | 7/2016 | Peters | H01R 4/203 |
| 9,397,410 | B2 * | 7/2016 | Corman | H01R 4/185 |
| 2014/0073205 | A1 | 3/2014 | Gery et al. | |
| 2016/0105013 | A1 * | 4/2016 | Fulponi | H02G 15/043 174/77 R |

FOREIGN PATENT DOCUMENTS

| | | | | |
|---|---|---|---|---|
| CN | 104067446 | A | 9/2014 | |
| DE | WO2004/047227 | A1 * | 6/2004 | H01R 4/62 |
| EP | 2706616 | A1 | 3/2014 | |
| WO | 2004047227 | A1 | 6/2004 | |

* cited by examiner

CRIMP CONNECTION SYSTEM FOR ELECTRICAL CABLES COMPRISING A FASTENING SLEEVE

CROSS-REFERENCE TO RELATED APPLICATIONS

This application is a national stage application under 35 U.S.C. § 371 of PCT Application No. PCT/EP2016/061140 having an international filing date of May 18, 2016, which designated the United States, said PCT application claiming the benefit of European Patent Application No. 15168742.3, filed May 21, 2015, the entire disclosure of each of which are hereby incorporated herein by reference.

TECHNICAL FIELD OF THE INVENTION

The invention relates to crimp connection systems, comprising at least one electrical cable and a contact terminal, having a crimp portion as well as a method to assemble a crimp connection system.

BACKGROUND OF THE INVENTION

Typical connection technologies for cables and in particular copper cables comprise crimping. Crimping is joining two pieces of metal or other ductile material by deforming one or both of them to hold each other. The bend or deformity is called the crimp. Typically, the metals are joined together via a special connector. The stripped cable that is often stranded, is inserted in an opening, such as a crimp portion, of the contact terminal. Then, a crimper is used to tightly squeeze the opening (i.e. the crimp portion) against the stripped cable.

Depending on the type of contact terminal used, the contact terminal may be attached to a metal plate or the like by a separate screw or bolt or the contact terminal could be simply screwed on using the contact terminal itself. Known crimp connections provide an electrical conductive connection that is able to withstand a certain amount of pullout force. The pullout force is typically understood as the force that is needed to pull out the stripped cable end from the crimping portion of the contact terminal in the longitudinal direction. The longitudinal direction is the direction of the cable axis.

However, in particular when using copper cables, crimp connections provide only a low protection against fretting corrosion. Fretting corrosion is a damage that occurs at the contact surfaces of the crimping portion of the contact terminal on the one hand, and at the contact surfaces of the stripped cable end on the other hand. This damage is induced under load, such as mechanical stress. The mechanical stress can e.g. be induced by the crimping itself and in the presence of repeated relative surface motion, as for example vibrations.

These vibrations can be a micro-movement between the outer strands of the cable end and the inner surface of the contact terminal. Typically, the relative sliding (micro) motion is in the range from certain nanometers to micrometers. The occurring fretting corrosion causes high and unstable ohmic resistance values of the crimped connection after a particular short time of use.

Further, the mechanical durability and in particular the pullout force that the crimp connection is able to withstand will be reduced due to fretting corrosion. Thus, there is a need in the art to improve conventional crimp connections in order to prevent fretting corrosion and to increase the pullout force that the crimp connection is able to withstand.

BRIEF SUMMARY OF THE INVENTION

A crimp connection system is presented herein. The crimp connection system for electrical cables includes an electrical cable having a stripped cable end, a fastening sleeve wherein the stripped cable end is arranged at least partially within the fastening sleeve, wherein the fastening sleeve comprises a number of fastening protrusions extending from the interior and/or outer surfaces of the fastening sleeve, wherein the fastening protrusions are distributed over the interior and/or outer surfaces of the fastening sleeve; and a contact terminal comprising a crimp portion wherein the fastening sleeve is arranged at least partially within the crimp portion.

Prior to crimping the crimp portion of the contact terminal onto the stripped cable end, the fastening sleeve is interposed between the stripped cable end and the contact terminal. Afterwards, the fastening sleeve is crimped together with the contact terminal on the stripped cable end of the electrical cable.

The fastening sleeve and in particular the fastening protrusions will create an additional form-fitting connection between the at least one strand of the stripped cable end and the crimp portion of the contact terminal. This additional form-fitting connection prevents or at least minimizes the micro movement between the at least one strand of the stripped cable end and the crimp portion of the contact terminal, so that reduced or even no fretting corrosion occurs. Thus, the electrical conductive connection between the cable and the contact terminal can be improved, since the ohmic resistance values of the crimped connection remain stable over time. Still further, the crimp connection is able to withstand higher pullout forces, due to the interposed fastening sleeve.

Preferably, the electrical cable comprises at least one strand, and wherein the at least one strand and/or contact terminal are formed from a material different than aluminum, preferably comprising copper or a copper-based alloy, e.g. brass or the like. Providing a fastening sleeve in crimp connections between e.g. copper-based components, such as a copper-based strand of a stripped cable and a copper-based contact terminal is advantageous, since particular copper and copper alloys are prone to fretting corrosion. Thus, by preventing micro movements and fretting corrosion as previously described, copper-based crimp connections can be significantly improved. Still further, the allowable pullout force of the crimped connection can be improved.

Preferably, the pullout force of the cable in longitudinal direction of the cable of the crimp connection system is at least 10% higher if the cable is crimped together with the fastening sleeve in the contact terminal compared to the cable being crimped without the fastening terminal in the contact terminal, wherein the pullout force is preferably between 6700-7200 N. Tests have shown that crimping a 35 $mm^2$ cable, such as a FL2G cable, having a core diameter of about 8.5 mm, in a copper-based contact terminal, will result in an allowable pullout force of about 6000-6500 N in longitudinal direction of the cable. By providing a fastening sleeve having a material thickness of about 0.3 mm and comprising a copper-tin alloy, the allowable pullout force increases by at least 10%, i.e. the allowable pullout force is in the example given, in the range between 6700-7200 N.

The object is further solved by a fastening sleeve for being used in a crimp connection system for electrical cables, wherein the fastening sleeve is adapted to be arranged within a crimp portion of a contact terminal and wherein a fastening sleeve is further adapted to be arranged circumferential around the stripped cable end of an electrical cable, the fastening sleeve comprising a number of fastening protrusions extending from the interior and/or outer surfaces of the fastening sleeve and wherein the fastening protrusions are distributed over the interior and/or the outer surfaces of the fastening sleeve.

The fastening sleeve that is interposed between a stripped cable end and a crimp portion of a contact terminal, provides an additional form-fitting connection and prevents the micro movement between the stripped cable end and the inner surface of the crimp portion of the contact terminal. Thus, fretting corrosion can be prevented or at least significantly reduced. Further, the allowable pullout force of the cable in the resulting crimp connection can be increased.

Preferably, the fastening protrusions of the fastening sleeve are formed as embossments, piercings, rim holes and/or a louver or a combination thereof. Embossments, piercings, rim holes and/or louvers can be manufactured by conventional stamping operations such as punching, blanking, embossing, bending, flanging, piercing or the like and therefore provide high production rates and low labor costs. Thus, the fastening sleeve can be manufactured economically. Further, using sheet metal cold forming procedures for manufacturing the fastening protrusions results in a strain hardening of the sleeve material in the area of the fastening protrusions. This strain hardened regions will further improve the form-fitting properties of the crimped connection. In particular, the hardened fastening protrusions can carve more easily into the material of the stripped cable end and/or the inner surface of the crimp portion of the contact terminal. Thus, an additional form fit can be achieved.

Preferably, the fastening protrusions have a substantially round cross section, having preferably a diameter of at most 3 mm, even more preferably of at most 1.5 mm and most preferably of at most 0.5 mm The smaller the fastening protrusions are, the more fastening protrusions can be provided. Providing a plurality of fastening protrusions is advantageous, since each fastening protrusion contributes to improving the connection between the stripped cable end and the fastening sleeve on the one hand and between the fastening sleeve and the crimp portion of the connector terminal on the other hand. Depending on the diameter of the cable to be connected, the size of the fastening protrusions can be adapted. Thus, when crimping larger cables, larger protrusions can be provided. Preferably, the characteristic dimension of the fastening protrusion, such as the diameter, is at most one tenth of the diameter of the stripped cable end, more preferably at most one twentieth and most preferably one thirtieth of the diameter of the stripped cable end. If the fastening protrusions are formed in a non-round cross section, the characteristic dimension may be the width of a rib or fin, or the like.

Preferably, the fastening sleeve comprises at least four, preferably at least 12 and most preferably at least 24 fastening protrusions. These fastening protrusions can be distributed over the inner and/or outer surface of the fastening sleeve, building rows or any other suitable geometric pattern. It is also possible to distribute the fastening protrusions randomly.

Preferably, the fastening sleeves is a substantially flat metal sheet or foil in an initial state, and is adapted to be formed in a substantially cylindrical form in an installed state. Providing a substantially flat metal sheet or foil in an initial state is advantageous, since the fastening protrusions can be manufactured more easily. Thus, conventional metal forming techniques, such as stamping, punching, blanking, embossing, piercing, bending and flanging among others, can be provided to form the outer contour of the fastening sleeves and to provide the fastening protrusions. Thus, manufacturing costs can be kept low.

Preferably, the fastening sleeve has a first and a second opposing edge, wherein the opposing edges are provided with an engaging contour, and wherein the engaging contour of the first edge engages with the engaging contour of the second edge in the final or installed state. The engaging contour can be formed in a zig-zag shaped form, in a wavy form or in any other suitable form such as protrusion and recesses. These engaging contours increase the allowable pullout force applied on the crimped connection, since the engaged edges prevent deformations of the fastening sleeve, when it is pulled in a longitudinal direction along the cable.

Thus, the allowable pullout force can be further increased. Preferably, the fastening sleeve is formed from a material comprising copper or a copper-based alloy and is preferably coated with an overcoat comprising any of zinc, tin, silver or gold or a combination thereof. Providing a fastening sleeve of a copper-based material is advantageous, since contact corrosion can be prevented. By over-coating the contact sleeve with further materials, the contact mating between the stripped cable end, the locking sleeve and the crimping portion of the connected terminal can be adjusted, so that possible contact corrosion can be prevented or at least reduced.

Preferably, the material of the fastening sleeve and in particular of the fastening protrusion has a rigidity that is higher than the rigidity of at least one strand of the electrical cable and the contact terminal, so that the fastening protrusions can carve into at least one of the strands and the contact terminal during crimping. Providing the increased rigidity is advantageous, since by carving into the contact terminal or the strands of the electrical cable, the fixation force of the fastening sleeve can be increased. The higher rigidity can, for example, be achieved by choosing a suitable material, or by strain hardening during manufacturing of the fastening protrusions. Thus, it is also possible to provide in particular similar material for the cable strand, the fastening sleeve and the connector terminal, as long as the material is appropriate to strain hardening.

Preferably, the fastening sleeve has a longitudinal length in the final or installed state of at least 8 mm, more preferably of at least 12 mm and most preferably of at least 15 mm By providing different longitudinal lengths, the fastening sleeve can be adapted to different crimp connections. Thus, it can be used over a wide range of crimp connections.

Preferably, the sheet thickness of the fastening sleeve is between 0.2 mm and 0.8 mm, more preferably between 0.3 mm and 0.7 mm and most preferably between 0.4 mm and 0.6 mm These material thicknesses are suitable to provide fastening sleeves that can be used in conventional crimp connections. Thus, the fastening sleeve can be added to known crimp pairings of electrical cables and connected terminals.

The object further can be solved by a method to assemble a crimp connection system comprising the following method steps:

a) arranging a fastening sleeve circumferentially around a stripped end of an electrical cable, wherein the fastening sleeve is preferably crimped on the stripped end of the electrical cable, with a crimping tool having a crimp surface provided with recesses that correspond to the fastening protrusions of the fastening sleeve;

b) arranging the fastening sleeve and the stripped end of the electrical cable within a crimp portion of a contact terminal; and c) crimping the contact terminal to fix the cable to the contact terminal.

By arranging the fastening sleeve interposed between the stripped end of the electrical cable and the crimp portion of the contact terminal, an additional form-fitting can be achieved. Thus, fretting corrosion can be prevented and electrical properties, such as electrical conductivity or the ohmic resistance of the crimped connection can be improved. Further, the allowable pullout force of the crimp connection can be increased.

Still further, by crimping the fastening sleeve on the stripped end of the electrical cable, arranging the fastening sleeve and the stripped end of the electrical cable within a crimp portion of a contact terminal is facilitated, since the fastening sleeve is prevented from falling off the stripped cable end. In this case, the crimping tool is advantageously provided with a crimp surface having recesses that correspond to the fastening protrusions of the fastening sleeve. Thus, the fastening protrusions are not damaged during the crimping of the fastening sleeve.

Preferably, the fastening sleeve is formed from a substantially flat metal sheet, wherein the fastening sleeve has first and second opposing edges wherein the opposing edges are provided with an engaging contour and wherein the method comprises the following step: forming the fastening sleeve in a substantially cylindrical form, so that the engaging contour of the first edge engages with the engaging contour of the second edge. These engaging edges further improve the pullout forces, since the fastening sleeve is less prone to deformation, when it is pulled in a longitudinal direction of the cable.

BRIEF DESCRIPTION OF THE SEVERAL VIEWS OF THE DRAWING

Other characteristics and advantages of the invention shall appear upon reading the detailed description and the appended drawings, in which.

DETAILED DESCRIPTION OF THE INVENTION

Figure 1A:
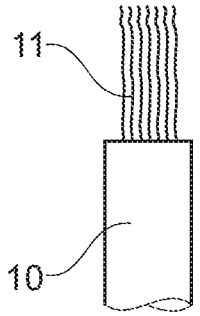
FIGS. 1A-1D show different assembly steps of a crimp connection system according to one embodiment.
Figure 1B:
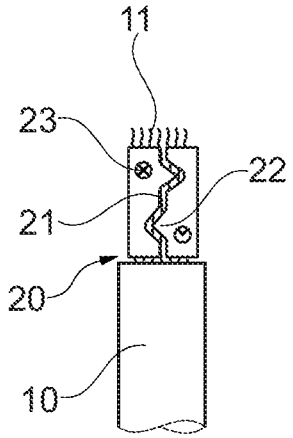
Figure 1C:
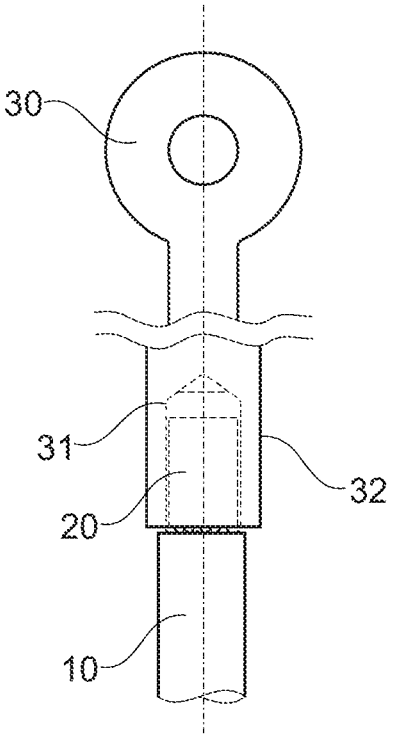

FIG. 1A shows the electrical cable 10 having a stripped cable end 11. In FIG. 1B the fastening sleeve 20 is arranged circumferential around the stripped cable end 11 of the electrical cable 10. The fastening sleeve 20 has fastening protrusions 23 and opposing edges 21, 22 provided with an engaging contour, wherein the engaging contour of the first edge 21 is engaged with the engaging contour of the second edge 22. The skilled person will recognize that the fastening sleeve 20 is essentially formed from a sheet metal that is rolled to an essentially cylindrical sleeve-like form. The assembly shown in FIG. 1B can be arranged within a crimping portion 31 of a contact terminal 30 as shown in FIG. 1C. The contact terminal 30 has a screwing portion that can be used to screw the contact terminal, for example on a screw contact of a battery or the like.

Figure 1D:
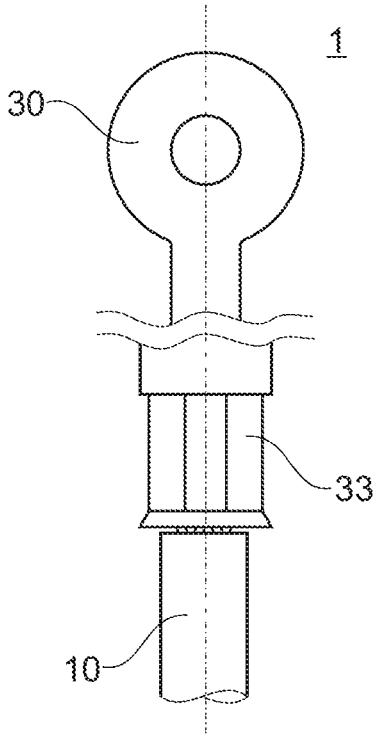

Further, the contact terminal 30 provides an outer surface 32 that will be deformed during crimping. FIG. 1D shows the crimp connection system in a crimped state. The outer surface 32 of the contact terminal 30 was crimped in a hexagonal form, resulting in the hexagonal outer surface 33 of the contact terminal 30. Thus, a crimp connection between the electrical cable 10 and the contact terminal 30 can be provided, comprising a fastening sleeve 20 that prevents the stripped cable end 11 and the crimping portion 31 of the contact terminal 30 from micro movement. Thus fretting corrosion is prevented.

Figure 2:
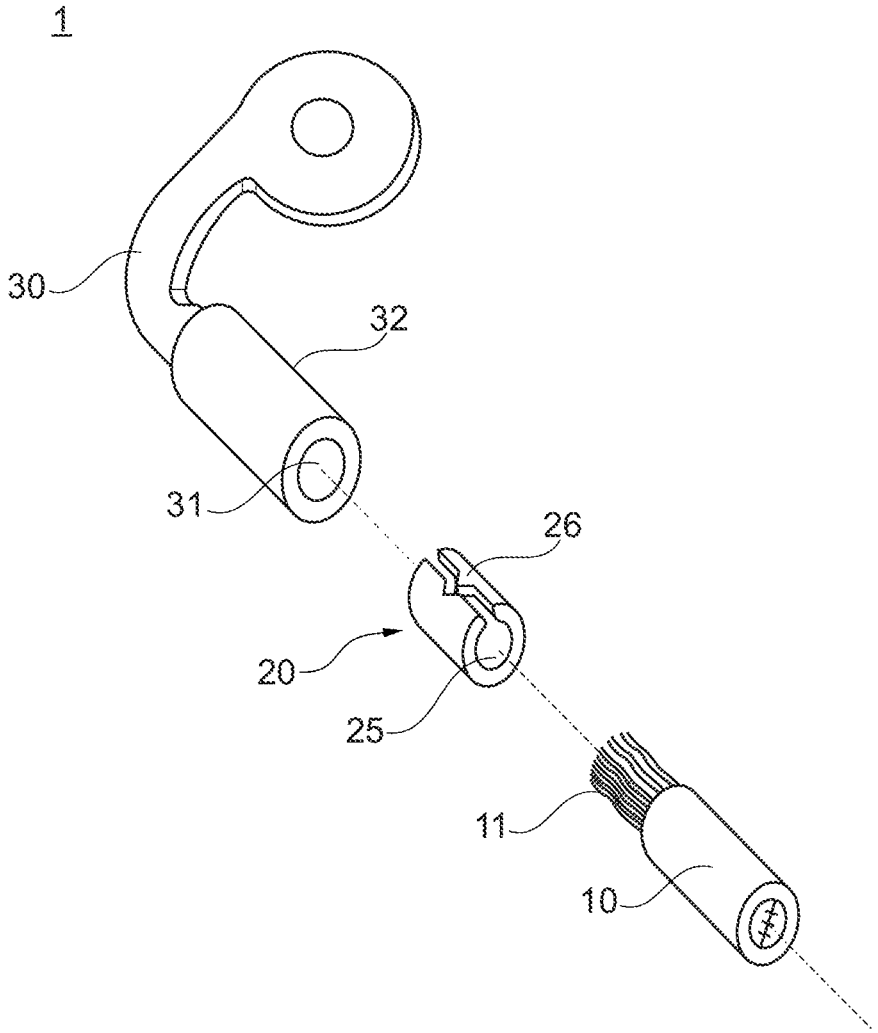
FIG. 2 shows an exploded view of the crimp connection system according to one embodiment.

FIG. 2 shows the crimp connection 1 in an exploded view. The electrical cable 10 provides a stripped cable end 11 that can be arranged within the fastening sleeve 20. The fastening sleeve 20 has an inner surface 25 and an outer surface 26 (the fastening protrusions are not shown in the schematic illustration of FIG. 2). Further, the fastening sleeve can be arranged within the crimping portion 31 of the contact terminal 30. The contact terminal 30 provides an outer surface 32 that can be deformed during crimping to a hexagonal surface, or the like, as shown in FIG. 1D.

Figure 3A:
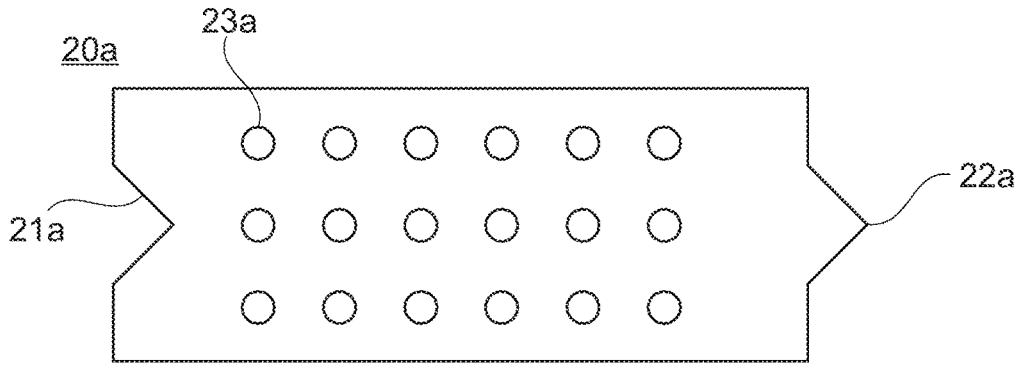
FIGS. 3A-3C show different embodiments of a fastening sleeve of the crimp connection system in an initial state according to one embodiment.
Figure 3B:
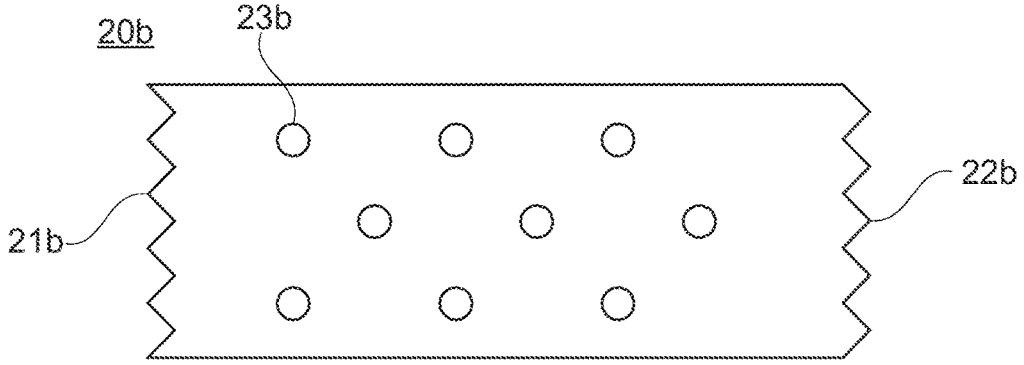
Figure 3C:
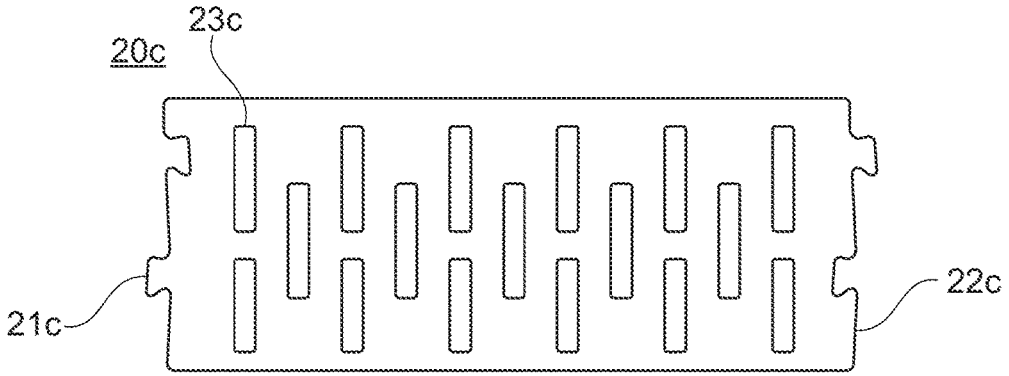

FIGS. 3A-3C show different embodiments of the fastening sleeves 20*a*, 20*b*, 20*c* in an initial respectively intermediate state. The fastening sleeves 20*a*, 20*b*, 20*c*, are formed from a substantially flat metal sheet or foil, preferably comprising copper or a copper-based alloy. These metal sheets can be formed by stamping methods such as punching, blanking, embossing, bending, piercing or flanging or the like. The fastening sleeves 20*a*, 20*b*, 20*c* provide opposing edges 21*a*, 22*a*, 21*b*, 22*b*, 21*c*, 22*c* wherein the opposing edges are provided with an engaging contour. The engaging contour shown in the fastening sleeves 20*a*, 20*b*, 20*c* are to be understood as exemplary contours. The contours can be formed in any suitable form that can be engaged with each other.

Fastening sleeve 20*a* is provided with an engaging contour having a triangular form. The engaging contour of edge 21*a* has a recessing contour whereas the engaging contour of edge 22*a* has a protruding contour. The engaging contours of fastening sleeve 20*b* are similar, however, certain protruding and recessing triangles are provided. The engaging contour of fastening sleeve 20*c* provides puzzle-piece-like protrusions and recesses that can engage with each other. Differently formed protrusions and recesses are also possible.

Further, the fastening sleeve 20*a* provides fastening protrusions 23*a* that are distributed in rows on a first surface of the fastening sleeve. Fastening sleeve 20*b* also provides fastening protrusions 23*b* that are distributed in form of rows that are offset from each other. As can be seen, the fastening protrusions 23*a* and 23*b* have a substantially round cross section. The number of fastening protrusions provided can vary. Preferably, at least eight or even more preferably at least 24 fastening protrusions are provided. Fastening sleeve 20*c* is provided with fastening protrusions 23*c*. These fastening protrusions 23*c* have a substantially rectangular cross section. These fastening protrusions 23*c* are displaced from each other. As can be best seen in FIG. 4, the fastening protrusions 23*a* can protrude from an inner surface and/or an outer surface of the fastening sleeve. These protrusions are preferably formed by stamping methods such as punching, blanking, embossing, bending, piercing or flanging or the like.

Figure 4:
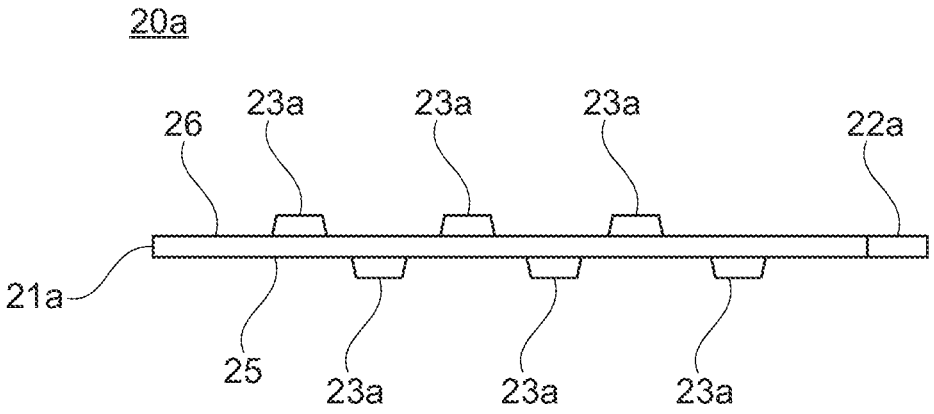
FIG. 4 shows the fastening sleeve of FIG. 3A in a side view according to one embodiment.

As FIG. 4 shows the fastening sleeve 20*a* in an initial or intermediate state, where the fastening sleeve is not yet formed to a substantially cylindrical form. Therefore, the fastening protrusions 23*a* can be formed by conventional stamping technique in a substantially flat metal sheet or metal foil. When the fastening sleeve 20*a*, shown in FIG. 4, is formed from the intermediate state to the final state as shown in FIG. 5, the inner surface 25*a* will be the inner most surface of the fastening sleeve 20*a* and the outer surface 26*a* will be the outer surface of the fastening sleeve 20*a*.

Figure 5:
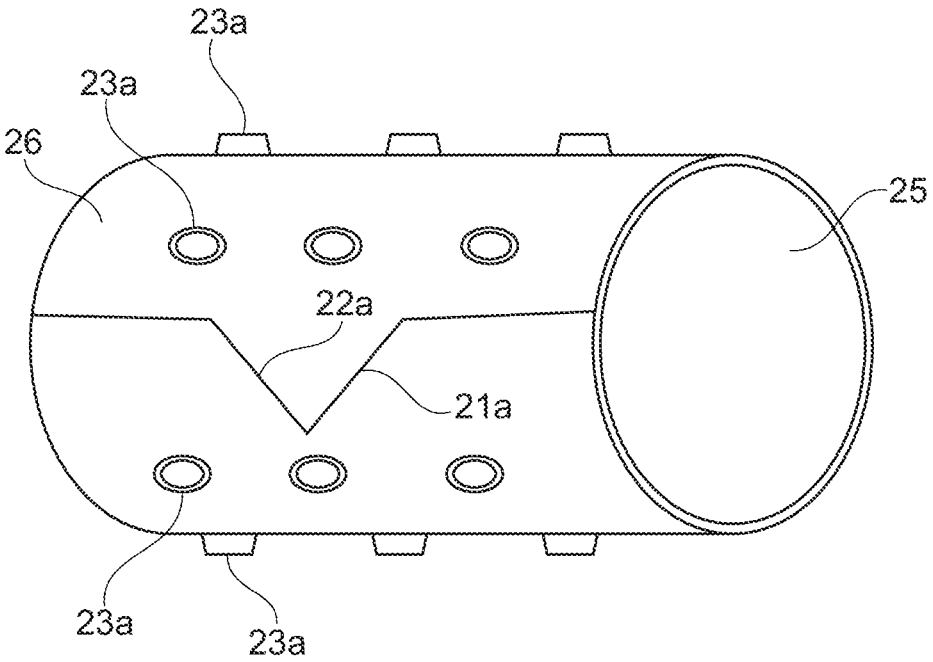
FIG. 5 shows the fastening sleeve of FIG. 4 in a final state according to one embodiment.

The final or installed state of the fastening sleeve 20*a* is shown in FIG. 5. As can be seen, the engaging contour of the opposing edges 21*a* and 22*a* engage with each other to prevent a deformation of the fastening sleeve in axial direction. Further, the fastening protrusions 23*a* protrude from the inner surface 25*a* (as shown by circles) and from the outer surface 26*a* of the fastening sleeve 20*a*. It has to be understood that also the fastening protrusions 23*b* and 23*c* can protrude from the inner and/or outer surface of the fastening sleeves.

The invention claimed is:

1. A crimp connection system for electrical cables, comprising:

an electrical cable having a stripped cable end;

a fastening sleeve, wherein the stripped cable end is arranged at least partially within the fastening sleeve, wherein the fastening sleeve comprises a plurality of fastening protrusions extending from an interior surface and an outer surface of the fastening sleeve, wherein the plurality of fastening protrusions of the fastening sleeve is formed as an embossment, a louver, or a combination thereof and wherein the plurality of fastening protrusions are distributed over the interior surface and the outer surface of the fastening sleeve; and a contact terminal comprising a crimp portion, wherein the fastening sleeve is arranged at least partially within the crimp portion.

2. The crimp connection system of claim 1, wherein the electrical cable is formed from aluminum and the contact terminal is formed of copper or a copper based alloy.

3. The crimp connection system of claim 2, wherein the plurality of fastening protrusions has a rigidity that is higher than the rigidity of the electrical cable and the contact terminal, so that the plurality of fastening protrusions can carve into the electrical cable and the contact terminal during crimping.

4. The crimp connection of claim 1, wherein the fastening sleeve is a substantially flat metal sheet or foil in an initial state, and is in an substantially cylindrical form, in an installed state.

5. The crimp connection system of claim 4, wherein the fastening sleeve has a first opposing edge and a second opposing edge, wherein the first opposing edge and the second opposing edge are each provided with an engaging contour, and wherein the engaging contour of the first opposing edge engages with the engaging contour of the second opposing edge in the installed state.

6. The crimp connection of claim 4, wherein the fastening sleeve has a longitudinal length in the installed state of at least 8 mm.

7. The crimp connection system of claim 1, wherein the fastening sleeve is formed from a material comprising copper or a copper based alloy and wherein the fastening sleeve is coated with an overcoat comprising zinc, tin, silver, or gold.

8. The crimp connection system of claim 1, wherein a sheet thickness of the fastening sleeve is between 0.2 mm and 0.8 mm.

9. The crimp connection system of claim 1, wherein the plurality of fastening protrusions define a frustoconical shape.

10. A method to assemble a crimp connection system, comprising the following steps:

a) arranging a fastening sleeve circumferentially around a stripped end of an electrical cable, wherein the fastening sleeve is crimped on the stripped end of the electrical cable, with a crimping tool having a crimp surface provided with recesses that correspond to a plurality of fastening protrusions of the fastening sleeve;

b) arranging the fastening sleeve and the stripped end of the electrical cable within a crimp portion of a contact terminal; and c) crimping the contact terminal to affix the electrical cable to the contact terminal.

11. The method of claim 10, wherein the fastening sleeve is formed from a substantially flat metal sheet, and wherein the fastening sleeve has a first opposing edge and a second opposing edge, wherein the first opposing edge and the second opposing edge are each provided with an engaging contour, and wherein the method further comprises the step of forming the fastening sleeve in a substantially cylindrical form such that the engaging contour of the first opposing edge engages with the engaging contour of the second opposing edge.

12. The method of claim 10, wherein the plurality of fastening protrusions extends from the interior and outer surfaces of the fastening sleeve, wherein the plurality of fastening protrusions of the fastening sleeve is formed as an embossment, a louver, or a combination thereof, and wherein the plurality of fastening protrusions is distributed over the interior and outer surfaces of the fastening sleeve.

13. The crimp connection system of claim 12, wherein the plurality of fastening protrusions has a substantially round cross section having a diameter of no more than 3 mm.

14. The crimp connection system of claim 12, wherein the fastening sleeve comprises at least four fastening protrusions.

15. The method of claim 12, wherein the plurality of fastening protrusions define a frustoconical shape.

16. The method of claim 15, wherein the recesses define a frustoconical shape.

* * * * *